US008958727B2

(12) United States Patent
Hayashida et al.

(10) Patent No.: US 8,958,727 B2
(45) Date of Patent: Feb. 17, 2015

(54) CARTRIDGE HAVING A REPLENISHMENT OPENING, AND IMAGE FORMING APPARATUS

(71) Applicant: Canon Kabushiki Kaisha, Tokyo (JP)

(72) Inventors: Makoto Hayashida, Numazu (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/705,537

(22) Filed: Dec. 5, 2012

(65) Prior Publication Data

US 2013/0149011 A1 Jun. 13, 2013

(30) Foreign Application Priority Data

Dec. 9, 2011 (JP) ..... 2011-270480

(51) Int. Cl.
*G03G 15/08* (2006.01)

(52) U.S. Cl.
CPC ..... *G03G 15/0834* (2013.01); *G03G 15/0877* (2013.01)
USPC ..... 399/263; 399/106; 399/258

(58) Field of Classification Search
USPC ..... 399/263, 262, 254, 258, 106
See application file for complete search history.

(56) References Cited

U.S. PATENT DOCUMENTS

| | | | | |
|---|---|---|---|---|
| 5,812,916 | A * | 9/1998 | Kishimoto et al. | 399/263 |
| 7,773,917 | B2 * | 8/2010 | Makino | 399/258 |
| 2009/0220285 | A1 * | 9/2009 | Kimura et al. | 399/263 |
| 2011/0229213 | A1 * | 9/2011 | Mihara et al. | 399/263 |
| 2013/0028638 | A1 * | 1/2013 | Tsuritani et al. | 399/258 |
| 2013/0121724 | A1 * | 5/2013 | Nittani | 399/263 |

FOREIGN PATENT DOCUMENTS

| | | | |
|---|---|---|---|
| JP | 2002-006601 | A | 1/2002 |
| JP | 2007-286290 | A | 11/2007 |
| JP | 2010-014890 | A | 1/2010 |
| JP | 2010-20227 | A | 1/2010 |
| JP | 2011-13366 | A | 1/2011 |

* cited by examiner

*Primary Examiner* — Sophia S Chen
(74) *Attorney, Agent, or Firm* — Canon USA Inc IP Division

(57) ABSTRACT

A cartridge detachably attachable to an image forming apparatus includes a developer storage chamber partitioned into a first storage portion and a second storage portion and configured to store a developer, a replenishment opening disposed in the second storage portion, through which the developer passes from inside the developer storage chamber to outside the developer storage chamber, and a conveyance member disposed in the second storage portion and configured to convey the developer in a predetermined conveying direction, the conveyance member including a first conveyance portion located on an upstream side of the replenishment opening to convey the developer in the conveying direction, and a second conveyance portion located on a downstream side of the replenishment opening to convey an amount of a developer smaller than that of the developer conveyed by the first conveyance portion in the conveying direction.

13 Claims, 14 Drawing Sheets

CARTRIDGE HAVING A REPLENISHMENT OPENING, AND IMAGE FORMING APPARATUS

BACKGROUND OF THE INVENTION

1. Field of the Invention

Aspects of the present invention relate to a cartridge detachably attachable to an image forming apparatus body, and an image forming apparatus using the cartridge.

2. Description of the Related Art

Conventionally, some image forming apparatuses have employed a process cartridge method for integrating an electrophotographic photosensitive member and a process unit operated on the electrophotographic photosensitive member into a cartridge and setting the cartridge to be detachably attachable to the image forming apparatus. The process cartridge method can improve operability by enabling a user to carry out maintenance of the apparatus.

The process cartridge includes a cleaning unit and a development unit. The cleaning unit includes an image bearing member serving as an electrophotographic photosensitive member, and a cleaning member for cleaning a surface of the image bearing member. The development unit includes a developing roller for supplying a developer to the image bearing member, and a developer storage portion for storing the developer.

As one of the process cartridge methods, a developer replenishment method is known. According to this method, a developer replenishment opening of a developer replenishment cartridge and a developer reception opening of the process cartridge are connected to each other, and the developer is supplied from the developer replenishment cartridge to the process cartridge.

In the developer replenishment method, when a new developer supplied from the developer replenishment cartridge mixes with an old developer in the development unit, it may adversely affect an image. Thus, the process cartridge of the developer replenishment method is configured as follows (page 14 and FIG. 4 of Japanese Patent Application Laid-Open No. 2010-014890).

The development unit is divided into a developing portion and the developer storage portion. The developing portion and the developer storage portion are connected to each other by openings formed at both ends of the image bearing member in a rotational axis direction (hereinafter, "longitudinal direction"). The developing portion and the developer storage portion respectively include a developer conveyance member for conveying the developer and a developer stirring member. The developer is conveyed in the longitudinal direction of the developer conveyance member and the developer stirring member. Thus, by circulating the developer in the development unit, the new developer and the old developer are uniformly mixed.

Such a developer replenishment method is configured as follows to stably supply the developer consumed by the process cartridge for forming an image from the developer replenishment cartridge to the process cartridge (page 12 and FIG. 7 of Japanese Patent Application Laid-Open No. 2002-006601).

The developer replenishment cartridge includes a replenishment frame member for storing the developer, a replenishment stirring member for stirring the developer, a replenishment conveyance member for conveying the developer to a developer replenishment opening, and a partition portion for covering the developer replenishment opening and a part of the longitudinal side of the replenishment conveyance member. The replenishment stirring member and the replenishment conveyance member are rotatably supported in the replenishment frame member. The replenishment stirring member stirs the developer in the replenishment frame member, and feeds the stirred developer to the replenishment conveyance member. The replenishment conveyance member conveys the developer to the developer replenishment opening through a developer conveyance portion partitioned by the replenishment frame member and the partition portion, thereby supplying the predetermined amount of a developer to the process cartridge.

In the developer replenishment cartridge, leakage of the developer from the replenishment frame member during a period after its production to its use by the user must be prevented. The replenishment frame member is accordingly sealed by bonding a replenishment opening sealing film to the developer replenishment opening. After this replenishment opening sealing film is removed by the user or automatically removed in the electrophotographic image forming apparatus, supplying of the developer to the process cartridge is enabled.

The developer in the developer replenishment cartridge may be pressed to harden, and then coagulate by vibration accompanying distribution after the production to the use by the user. Especially, when during the distribution, the developer replenishment cartridge takes an attitude so that its longitudinal direction overlaps a vertical direction, and a conveying direction downstream side of the replenishment conveyance member is a bottom surface, the coagulated developer accumulates on the conveying direction downstream side of the replenishment conveyance member. When the developer replenishment cartridge is used in this state, the coagulated developer is further pressed to harden by the replenishment conveyance member, and thus driving torque of the replenishment conveyance member increases. To deal with this driving torque increase, the size of a driving motor may be increased, consequently creating problems of a cost increase and a space increase.

SUMMARY OF THE INVENTION

Aspects of the present invention relate to suppression of an increase of torque necessary during the use of a cartridge even when a developer in the cartridge coagulates due to vibration accompanying the distribution of cartridges.

According to an aspect of the present invention, a cartridge detachably attachable to an image forming apparatus includes a developer storage chamber partitioned into a first storage portion and a second storage portion and configured to store a developer, a replenishment opening disposed in the second storage portion, through which the developer passes from inside the developer storage chamber to outside the developer storage chamber, and a conveyance member disposed in the second storage portion and configured to convey the developer in a predetermined conveying direction, the conveyance member including a first conveyance portion located on an upstream side of the replenishment opening to convey the developer in the conveying direction, and a second conveyance portion located on a downstream side of the replenishment opening to convey an amount of a developer smaller than that of the developer conveyed by the first conveyance portion in the conveying direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
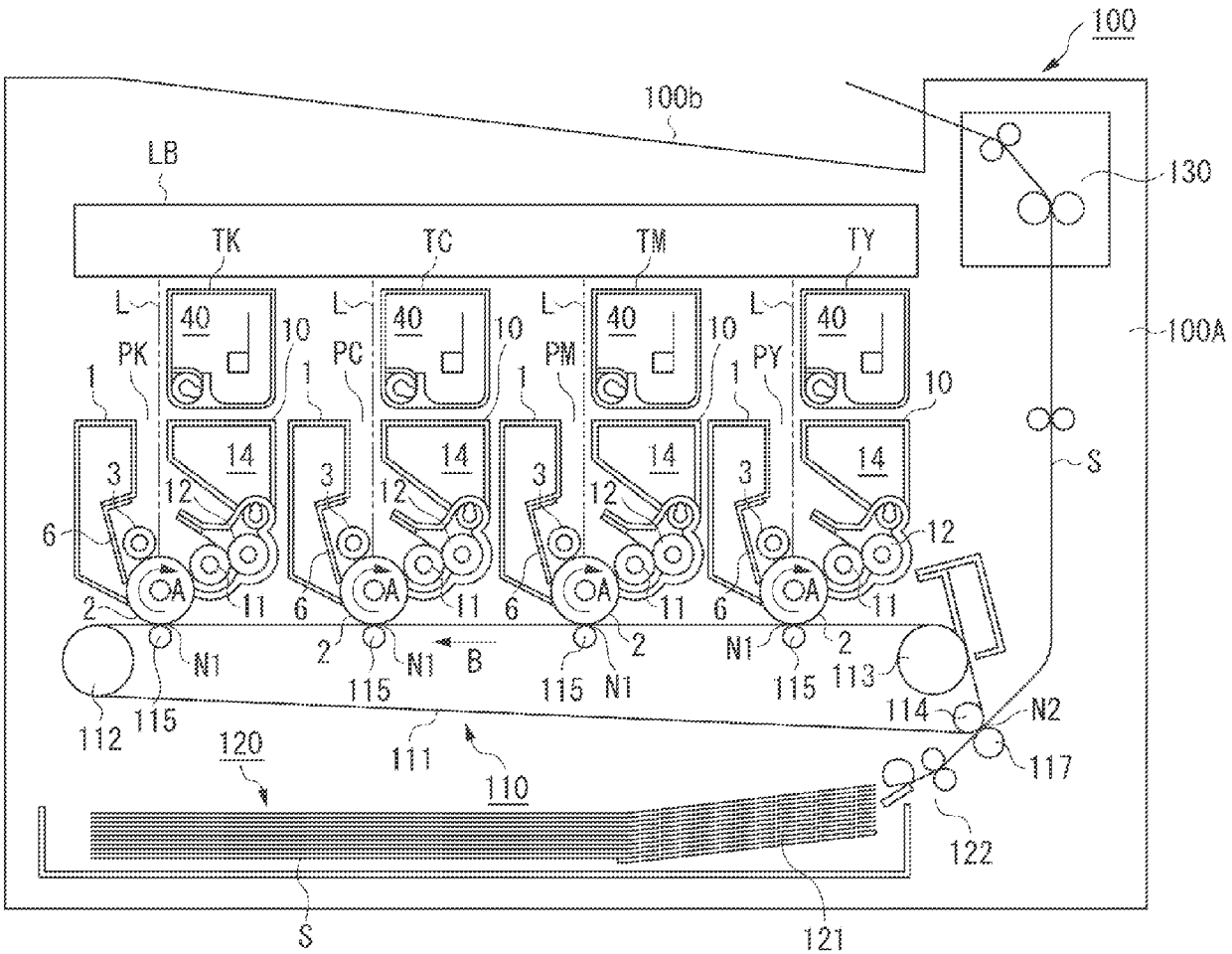
FIG. 2 is a schematic sectional view illustrating a color electrophotographic image forming apparatus.
Figure 3:
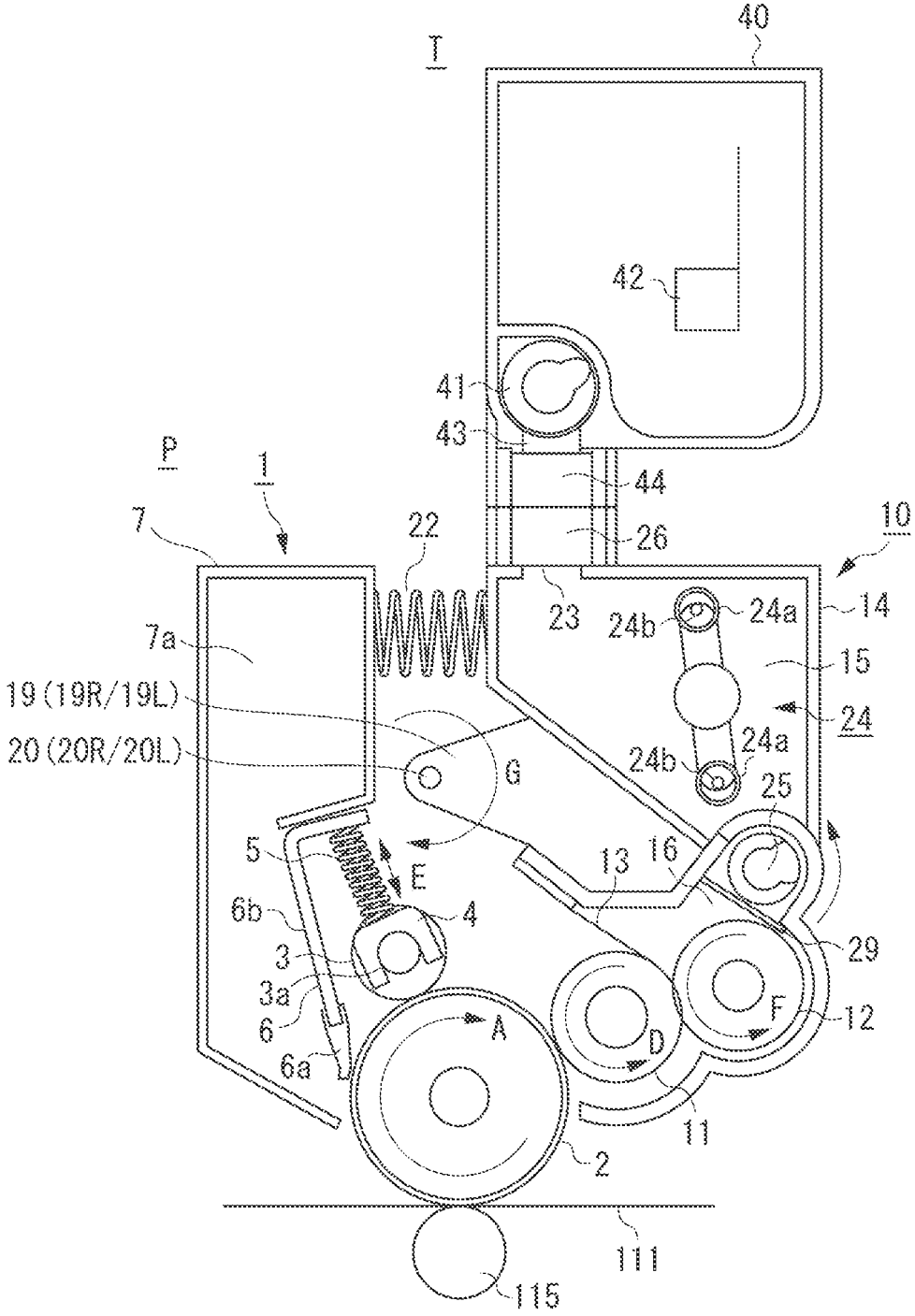
FIG. 3 is a main sectional view illustrating a process cartridge and the developer replenishment cartridge.

First, referring to FIGS. 2 and 3, an overall configuration of an image forming apparatus according to a first exemplary embodiment will be described. FIG. 2 is a schematic sectional view illustrating a color electrophotographic image forming apparatus. FIG. 3 is a main sectional view illustrating a process cartridge and a developer replenishment cartridge.

The image forming apparatus 100 illustrated in FIG. 2, which is a four-full-color laser beam printer using an electrophotographic image forming process, forms a color image on a recording medium S. The image forming apparatus 100 uses a process cartridge method. According to this method, a process cartridge P and a developer replenishment cartridge T, which are detachable cartridges, are mounted to an image forming apparatus body 100A to form a color image on the recording medium S.

Hereinafter, the image forming apparatus body (hereinafter, "apparatus body") 100A means a portion of the image forming apparatus where the process cartridge P and the developer replenishment cartridge T are removed.

The apparatus body 100A is provided with first to fourth process cartridges P (PY, PM, PC, and PK) and developer replenishment cartridges T (TY, TM, TC, and TK) arranged side by side in a horizontal direction. The process cartridges P and the developer replenishment cartridges T, which respectively have similar electrophotographic image forming process mechanisms, are different in color and filling amount of developers. Rotational driving forces are transmitted from the apparatus body 100A to the process cartridge P and the developer replenishment cartridge T. A bias (charging bias or developing bias) is supplied to the process cartridge P from the apparatus body 100A. The process cartridge P and the developer replenishment cartridge T are independently detachably attachable to the apparatus body 100A.

In the present exemplary embodiment, as illustrated in FIG. 3, each process cartridge P includes a cleaning unit 1 and a development unit 10. The cleaning unit 1 includes an electrophotographic photosensitive drum (hereinafter, "photosensitive drum") 2 serving as an image bearing member, a charging roller 3 operated on the photosensitive drum 2, and a cleaning member 6. The development unit 10 includes a developing device that develops an electrostatic image on the photosensitive drum 2. The cleaning unit 1 and the development unit 10 are coupled together to swing.

The first process cartridge PY stores a yellow (Y) developer in a developer storage portion 15, and forms a Y developer image on the photosensitive drum 2. Similarly, the second process cartridge PM, the third process cartridge PC, and the fourth process cartridge PK respectively store magenta (M), cyan (C), and black (K) developers.

The first developer replenishment cartridge TY stores a Y developer in a replenishment frame member 40, and supplies the Y developer to the process cartridge PY storing the developer of the same color. Similarly, the second developer replenishment cartridge TM stores a M developer, and supplies the M developer to the process cartridge PM storing the developer of the same color. Similarly, the third developer replenishment cartridge TC stores a C developer, and supplies the C developer to the process cartridge PC storing the developer of the same color. Similarly, the fourth developer replenishment cartridge TK stores a K developer, and supplies the K developer to the process cartridge PK storing the developer of the same color. A replenishment operation of the developer replenishment cartridge T is carried out when a developer residual amount detection unit (not illustrated) disposed in the apparatus body 100A detects a developer residual amount shortage in the process cartridge P.

As illustrated in FIG. 3, the replenishment frame member 40 of the developer replenishment cartridge T includes a developer replenishment opening 43 formed to supply the developer to the process cartridge P. The developer storage portion 15 of the process cartridge P includes a developer reception opening 23 corresponding to the developer replenishment opening 43. After the process cartridge P and the developer replenishment cartridge T have been fixed to the apparatus body 100A, the developer replenishment opening 43 and the developer reception opening 23 communicate with each other to supply the developer from the developer replenishment cartridge T to the process cartridge P.

The process cartridge P and the developer replenishment cartridge T will be described below in detail.

As illustrated in FIG. 2, a laser scanner unit LB is disposed to serve as an exposure unit above the process cartridges P (PY, PM, PC, and PK). The laser scanner unit LB outputs a laser beam L corresponding to image information. The laser beam L scans and exposes a surface of the photosensitive drum 2.

An intermediate transfer belt unit 110 is disposed to serve as a primary transfer member below the process cartridges P (PY, PM, PC, and PK). The intermediate transfer belt unit 110 includes a flexible endless transfer belt 111, a driving roller 112 for setting the transfer belt 111 tense to rotate, a driven roller 113, and a secondary transfer counter roller 114. The photosensitive drum 2 of each process cartridge P is in contact with the transfer belt 111. A contact portion N1 between the photosensitive drum 2 and the transfer belt 111 is a primary transfer portion. Inside the transfer belt 111, a primary transfer roller 115 is disposed to face the photosensitive drum 2. In a position facing the secondary transfer counter roller 114, a secondary transfer roller 117 is disposed to serve as a secondary transfer member. A contact portion N2 between the transfer belt 111 and the secondary transfer roller 117 is a secondary transfer portion.

A sheet feeing unit 120 is disposed below the intermediate transfer belt unit 110. The sheet feeding unit 120 includes a sheet feeding tray 121 for storing the recording medium S and a sheet discharging roller 122.

A fixing unit 130 is disposed in an upper portion in the apparatus body 100A. A top surface of the apparatus body 100A is a discharge tray 100*b*.

Next, referring to FIG. 2, a full-color image forming operation will be described. FIG. 2 is a schematic sectional view illustrating the color electrophotographic image forming apparatus.

The full-color image forming operation is as follows.

The photosensitive drums 2 of the first to fourth process cartridges P (PY, PM, PC, and PK) are driven to rotate at a predetermined speed in an arrow direction A illustrated in FIG. 2. The transfer belt 111 is driven to rotate in an arrow direction B (forward direction with respect to photosensitive drum rotation). In this case, the speed of the transfer belt 111 corresponds to those of the photosensitive drums 2. Simultaneously, the laser scanner unit LB is driven.

In synchronization with the driving of the laser scanner unit LB, the charging roller 3 of each process cartridge P uniformly charges the surface of the photosensitive drum 2 with predetermined polarity or potential. The laser scanner unit LB scans and exposes the surface of each photosensitive drum 2 with a laser beam L according to an image signal of each color. An electrostatic latent image is accordingly formed on the surface of each photosensitive drum 2 according to the image signal of a corresponding color. The formed electrostatic latent image is developed by the developing roller 11.

As a result of the image forming operation, a Y developer image is formed on the photosensitive drum 2 of the first process cartridge PY. Then, the Y developer image is primarily transferred to the transfer belt 111. Similarly, developer images of the second process cartridge PM, the third process cartridge PC, and the fourth process cartridge PK are superimposed on the transfer belt 111 to form unfixed developer images of four full colors.

The recording medium S stored in the sheet feeding tray 121 is fed at predetermined control timing. The developer images of the four full colors on the transfer belt 111 are transferred en bloc to the surface of the recording medium S introduced to the secondary transfer portion N2.

The recording medium S is separated from the surface of the transfer belt 111 to be introduced to the fixing unit 130, and then heated or pressed at a fixing nip portion. The developer images are accordingly fixed onto the recording medium S. Then, the recording medium S on which the developer images have been fixed is conveyed to the discharge tray 100*b*, thereby completing the full-color image forming operation.

Figure 4:
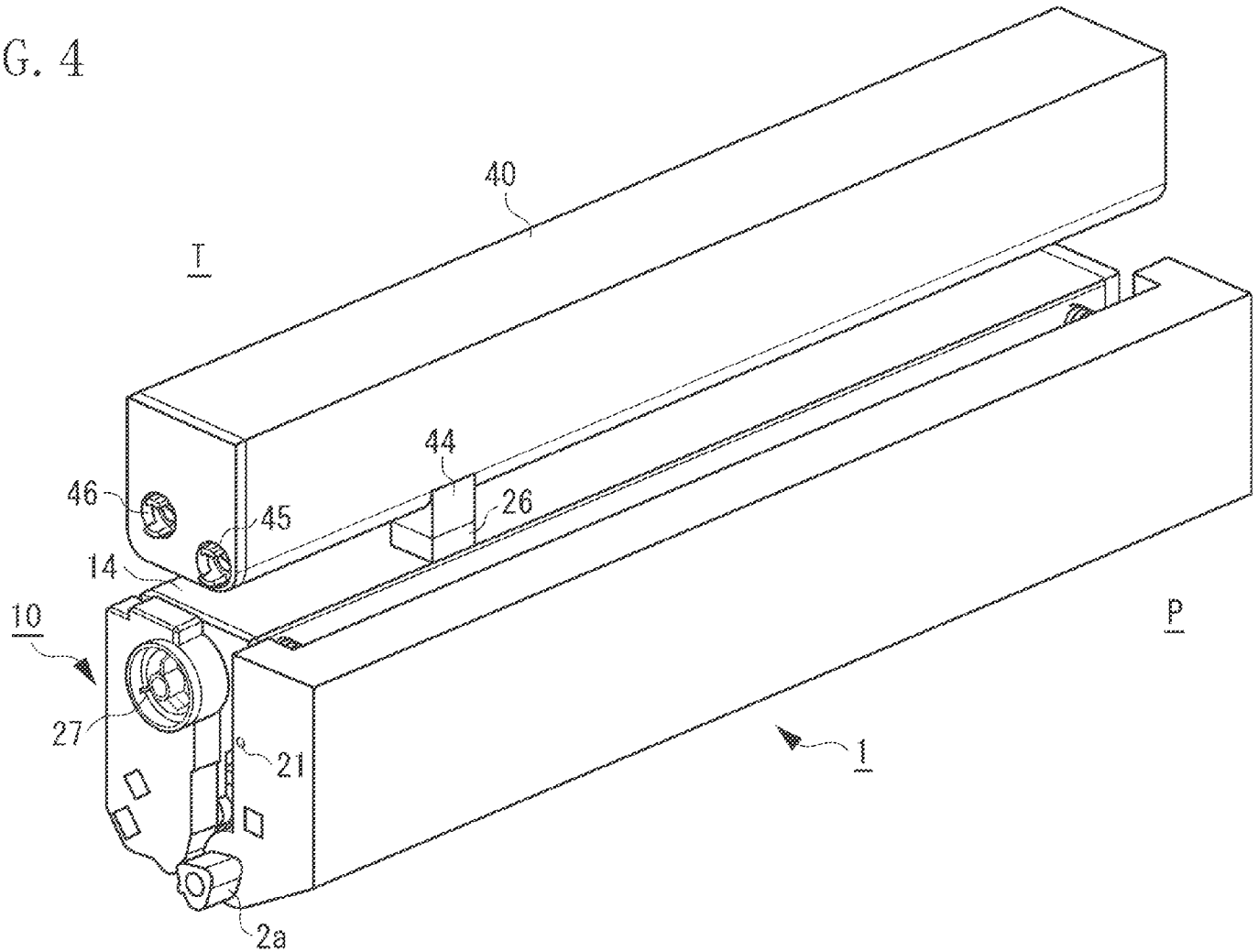
FIG. 4 is a perspective view illustrating an overall image of the process cartridge and the developer replenishment cartridge in the image forming apparatus.
Figure 5:
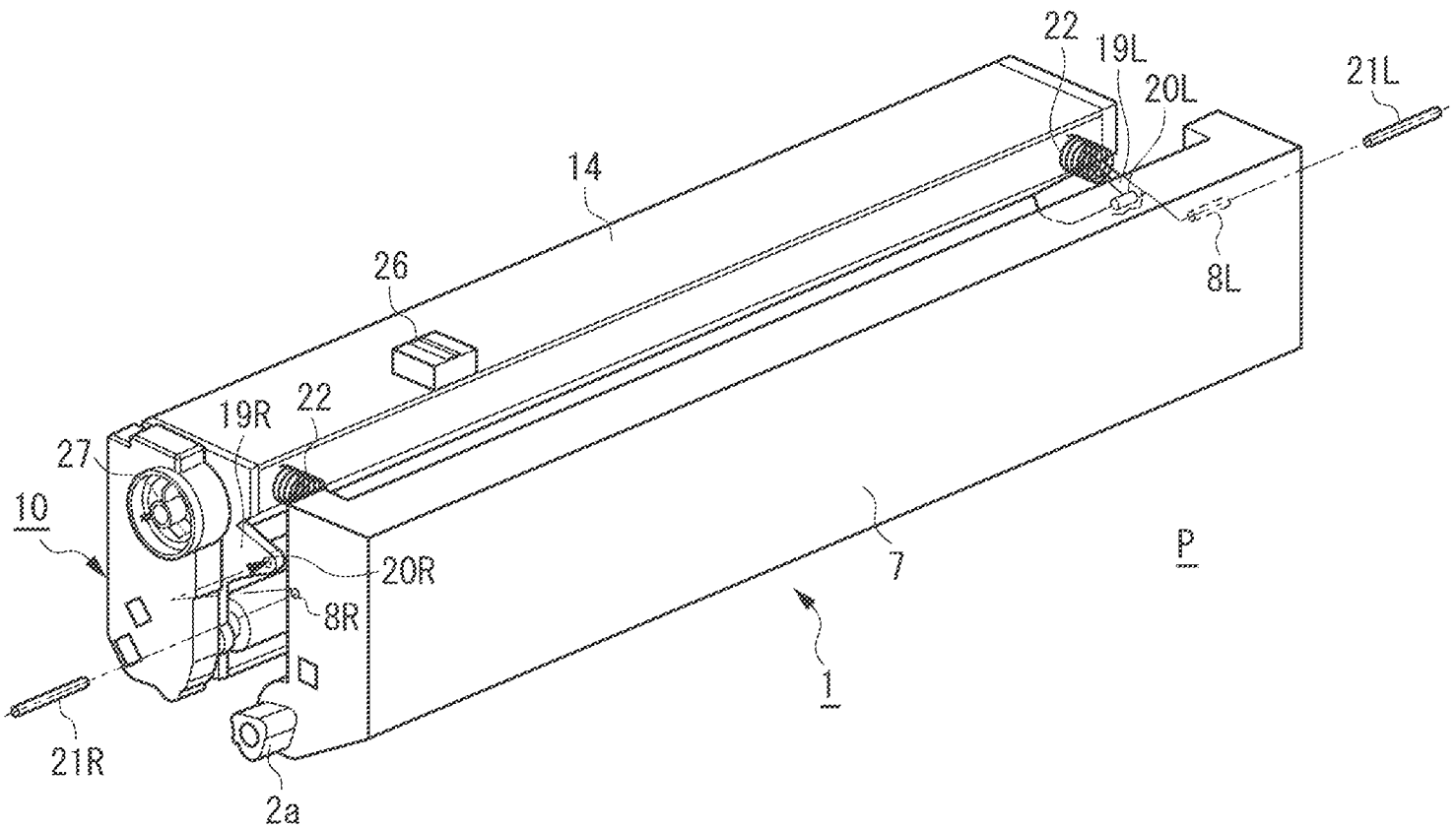
FIG. 5 is a perspective view illustrating the overall image of the process cartridge.

Next, referring to FIGS. 3 to 5, an overall configuration of the process cartridge P will be described. FIG. 3 is a main sectional view illustrating the process cartridge and the developer replenishment cartridge. FIG. 4 is a perspective view illustrating an overall image of the process cartridge and the developer replenishment cartridge in the image forming apparatus body. FIG. 5 is a perspective view illustrating the overall image of the process cartridge.

As illustrated in FIG. 3, each of the process cartridges P (PY, PM, PC, and PK) includes the cleaning unit 1 and the development unit 10.

First, the cleaning unit 1 will be described. The cleaning unit 1 includes the photosensitive drum 2, the charging roller 3, and the cleaning member 6 in its cleaning frame member 7.

The photosensitive drum 2 is rotatably supported by the cleaning frame member 7. At one end of the photosensitive drum 2, as illustrated in FIG. 4, a drum driving coupling 2*a* is disposed. The photosensitive drum 2 and the drum driving coupling 2*a* are integrally formed. The drum driving coupling 2*a* is engaged with a coupling (not illustrated) of the apparatus body 100A. By transmitting a driving force of a driving motor (not illustrated) of the apparatus body 100A to the drum driving coupling 2*a*, the photosensitive drum 2 is driven to rotate at a predetermined speed in an arrow direction A illustrated in FIG. 3.

The charging roller 3 is driven to rotate in contact with the photosensitive drum 2. As illustrated in FIG. 3, the charging roller 3 is attached to the cleaning frame member 7 via a charging roller bearing 4. The charging roller 3 is attached along a line connecting rotational centers of the charging roller 3 and the photosensitive drum 2 with each other to be movable in an arrow direction E. A rotary shaft 3*a* of the charging roller 3 is rotatably supported by the charging roller bearing 4. The charging roller bearing 4 is pressed toward the photosensitive drum 2 by a charging roller pressure member 5.

The cleaning member 6 includes a leading-end elastic rubber blade 6*a* and a support plate 6*b*. The leading end of the elastic rubber blade 6*a* abuts on the photosensitive drum 2 in a direction opposite the rotational direction (arrow direction A illustrated in FIG. 3) of the drum. The cleaning member 6 removes the developer left on the photosensitive drum 2. The developer removed from the peripheral surface of the photosensitive drum 2 is stored in a removed developer storage portion 7*a* of the cleaning frame member 7.

Next, the development unit 10 will be described. As illustrated in FIG. 3, the development unit 10 includes a development frame member 14 for supporting various elements in the development unit 10. The development frame member 14 is divided into a developing portion 16 and a developer storage portion 15.

The developing portion 16 includes a developing roller 11, a developer supply roller (hereinafter, "supply roller") 12, and a developing blade 13. The developing roller 11 contacts the photosensitive drum 2 to rotate in an arrow direction D. The supply roller 12 contacts the developing roller 11 to rotate in an arrow direction F. The supply roller 12 has two roles: one supplies the developer to the developing roller 11, and the other scraps off the developer left on the developing roller 11 that is not used for development. The developing blade 13 contacts the peripheral surface of the developing roller 11 to regulate a layer thickness of the developer on the developing roller 11.

The developer storage portion 15 stores the developer supplied from the developer replenishment cartridge T. The developer storage portion 15 will be described below in detail.

Next, coupling of the cleaning unit 1 with the development unit 10 will be described. As illustrated in FIG. 5, the cleaning frame member 7 has cleaning coupling holes 8 (8R and 8L). As illustrated in FIGS. 3 and 5, the development frame member 14 includes development side plates 19 (19R and 9L) at both ends in a longitudinal direction. The development side plates 19 (19R and 9L) have development coupling holes 20 (20R and 20L). As illustrated in FIG. 5, the cleaning coupling holes 8 (8R and 8L) and the development coupling holes 20 (20R and 20L) are engaged with coupling shafts 21 (21R and 21L), and accordingly coupled together to swing. Thus, the cleaning unit 1 and the development unit 10 are coupled together.

As illustrated in FIGS. 3 and 5, a pressure spring 22 is disposed between the cleaning unit 1 and the development unit 10. By a pressing force of the pressure spring 22, the development unit 10 acquires rotational moment around the development coupling hole 20 in an arrow direction G. The developing roller 11 accordingly abuts on the photosensitive drum 2.

In the present exemplary embodiment, the developing roller 11 is disposed in contact with the photosensitive drum 2. However, the developing roller 11 can be spaced by a predetermined amount from the photosensitive drum 2.

Figure 7:
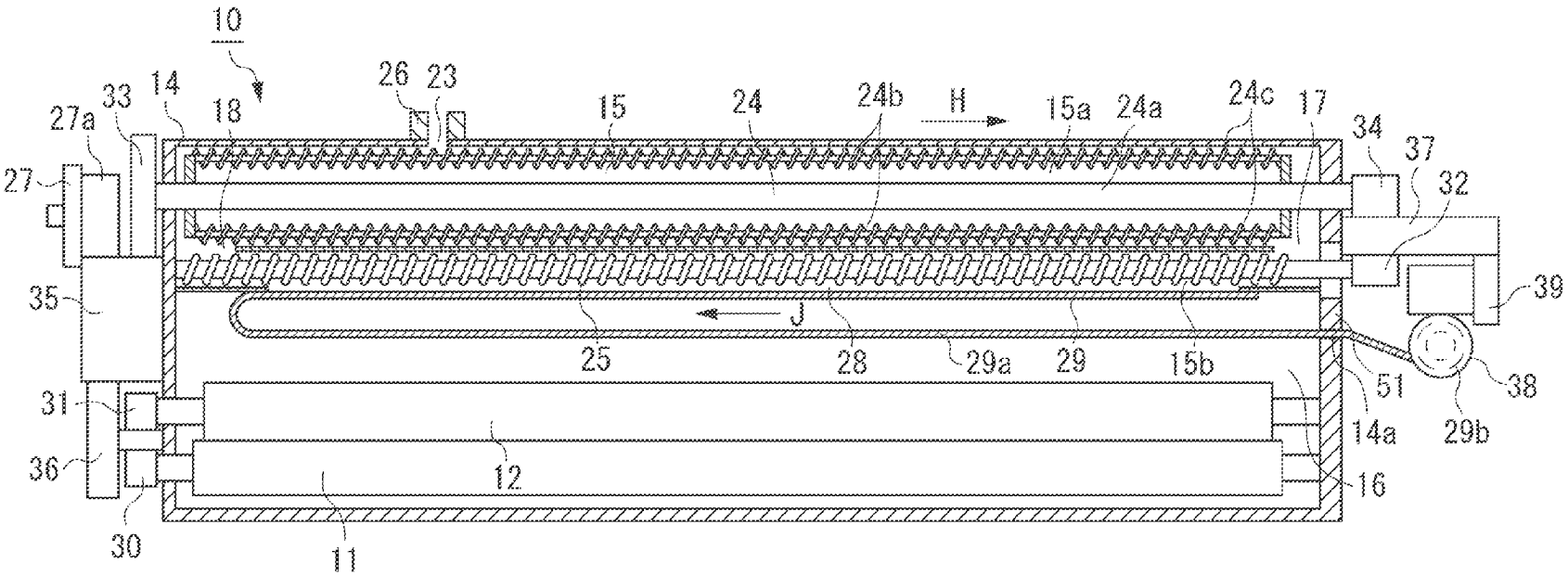
FIG. 7 is a sectional view illustrating a configuration of a development unit.
Figure 8:
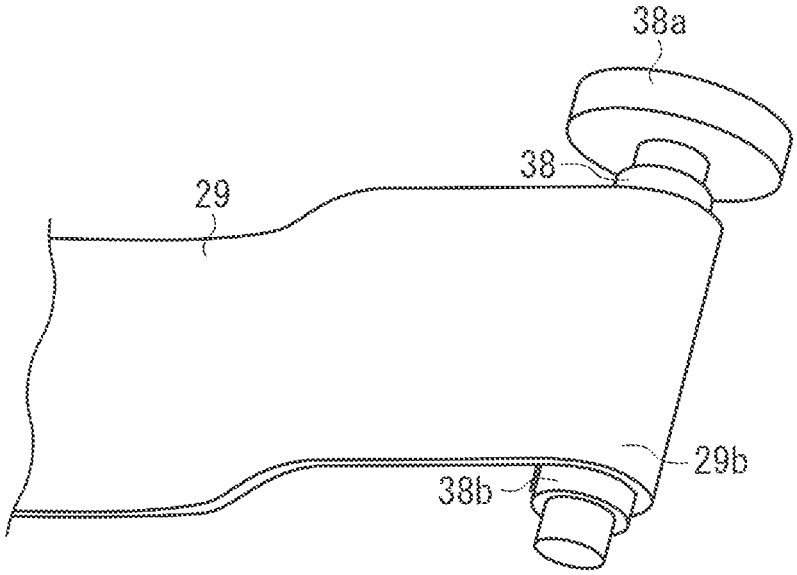
FIG. 8 is a perspective view illustrating a coupling configuration of a sealing member and a take-up member.

Next, referring to FIGS. 7 and 8, a configuration of the developer storage portion will be described. FIG. 7 is a sectional view illustrating a configuration of the development unit. FIG. 8 is a perspective view illustrating a coupling configuration of a sealing member and a take-up member.

As illustrated in FIG. 7, the developer storage portion 15 is divided into a first storage portion 15*a* and a second storage portion 15*b*. The first storage portion 15*a* and the second storage portion 15*b* are connected to each other by a first opening 17 and a second opening 18 formed at both ends in a longitudinal direction.

The first storage portion 15*a* includes a developer reception opening 23. A developer reception shutter 26 is disposed in an upper side of the developer reception opening 23. Normally, the developer reception shutter 26 is closed. However, when the process cartridge P and the developer replenishment cartridge T are fixed to the apparatus body 100A, the developer reception shutter 26 is opened.

The second storage portion 15*b* is connected to the developing portion 16 via a development opening 28. During non-use of the process cartridge P, the development opening 28 is sealed with a sealing member 29. The sealing member 29 prevents leakage of the developer from the developer storage portion 15 during the distribution of the process cartridge P. The sealing member 29 is welded to a surface of the development opening 28. One longitudinal end of the sealing member 29 is folded, and passes through a seal opening 14*a* formed in the development frame member 14 to extend to the outside of the development frame member 14. The seal opening 14*a* includes a sealing member 51 formed to prevent leakage of the developer from the seal opening 14*a*. A longitudinal end 29*b* of a folded portion 29*a* of the sealing member 29 is coupled with a take-up member 38 outside the development frame member 14. As illustrated in FIG. 8, the take-up member 38 includes a take-up gear portion 38*a* and a take-up shaft portion 38*b*. The sealing member 29 is bonded to the take-up shaft portion 38*b* by a double-sided adhesive tape. When the process cartridge P is used, the sealing member 29 is taken up by the take-up portion 38 to be removed. A removing configuration of the sealing member will be described below in detail.

The first storage portion 15*a* includes a developer stirring member 24. The developer stirring member 24 has two roles: one is mixing of a developer supplied from the developer replenishment cartridge T with a developer in the developer storage portion 15, and the other is conveyance of the mixed developer in an arrow direction H. The developer stirring member 24 is configured by attaching a stirring spring 24*c* to a developer support shaft 24*b* disposed around a development stirring shaft 24*a*. The second storage portion 15*b* includes a developer conveyance member 25. The developer conveyance member 25 is a screw member for conveying the developer in an arrow direction J. The developer conveyance member 25 will be described below in detail.

Conveyance of the developer in the development unit 10 will now be described. The developer supplied from the developer replenishment cartridge T is mixed with the developer in the developer storage portion 15 by the developer stirring member 24 in the first storage portion 15*a*. The mixed developer is fed through the first opening 17 to the second storage portion 15*b*. In the second storage portion 15*b*, the developer is conveyed from the development opening 28 to the developing portion 16 by the developer conveyance member 25. The developer conveyed to the developing portion 16 is fed from the supply roller 12 to the developing roller 11 to be developed. The developer not subjected to development is returned from the developing portion 16 to the second storage portion 15*b*. Then, the developer is conveyed from the second opening 18 to the first storage portion 15*a* by the developer conveyance member 25.

Next, referring to FIGS. 5 and 7, a driving configuration of the development unit 10 will be described. FIG. 5 is a perspective view illustrating an overall image of the process cartridge P. FIG. 7 is a sectional view illustrating a configuration of the development unit 10.

As illustrated in FIG. 7, at one end of the developing roller 11, a developing roller driving gear 30 is disposed to transmit driving to the developing roller 11. At one end of the supply roller 12, a supply roller driving gear 31 is disposed to transmit driving to the supply roller 12. At one end of the developer conveyance member 25, a development conveyance gear 32 is disposed to transmit driving to the developer conveyance member 25. At one end of the developer stirring member 24, a first development stirring gear 33 is disposed to transmit driving to the developer stirring member 24. At the other end of the developer stirring member 24, a second development stirring gear 34 is disposed to transmit driving from the developer stirring member 24.

As illustrated in FIG. 5, a development driving coupling 27 is disposed at one longitudinal end of the development unit 10. The development driving coupling 27 is engaged with the coupling (not illustrated) of the apparatus body 100A. After reception of a driving force of the driving motor (not illustrated) of the apparatus body 100A, the development driving coupling 27 rotates at a predetermined speed.

The driving force of the driving motor of the apparatus body 100A is transmitted from the development driving coupling 27 through the following path.

As illustrated in FIG. 7, driving of the development driving coupling 27 is transmitted from a gear portion 27*a* of the development driving coupling 27 to the developing roller driving gear 30 and the supply roller driving gear 31 via a first idler gear 35 and a second idler gear 36. The developing roller 11 and the supply roller 12 are accordingly driven to rotate.

Driving of the first idler gear 35 is also transmitted to the first development stirring gear 33 to drive the developer stirring member 24. Driving of the developer stirring member 24 is transmitted from the second development stirring gear 34 to the development conveyance gear 32 via a third idler gear 37. The developer conveyance member 25 is accordingly driven to rotate.

Driving of the third idler gear 37 is also transmitted to a fourth idler gear 39. Driving of the fourth idler gear 39 is transmitted to the take-up gear portion 38*a* of the take-up member 38, and the take-up member 38 is accordingly driven to rotate. Thus, the sealing member 29 is taken up to be removed from the development opening 28.

Figure 1:
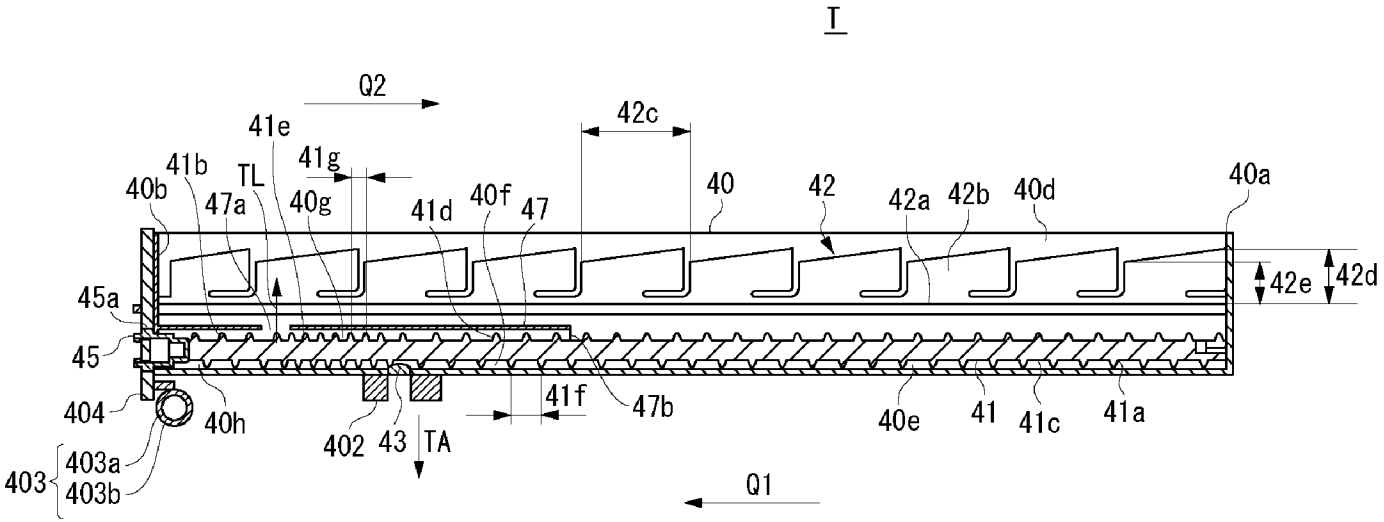
FIG. 1 is a schematic sectional view illustrating a configuration of a developer replenishment cartridge according to a first exemplary embodiment.
Figure 6:
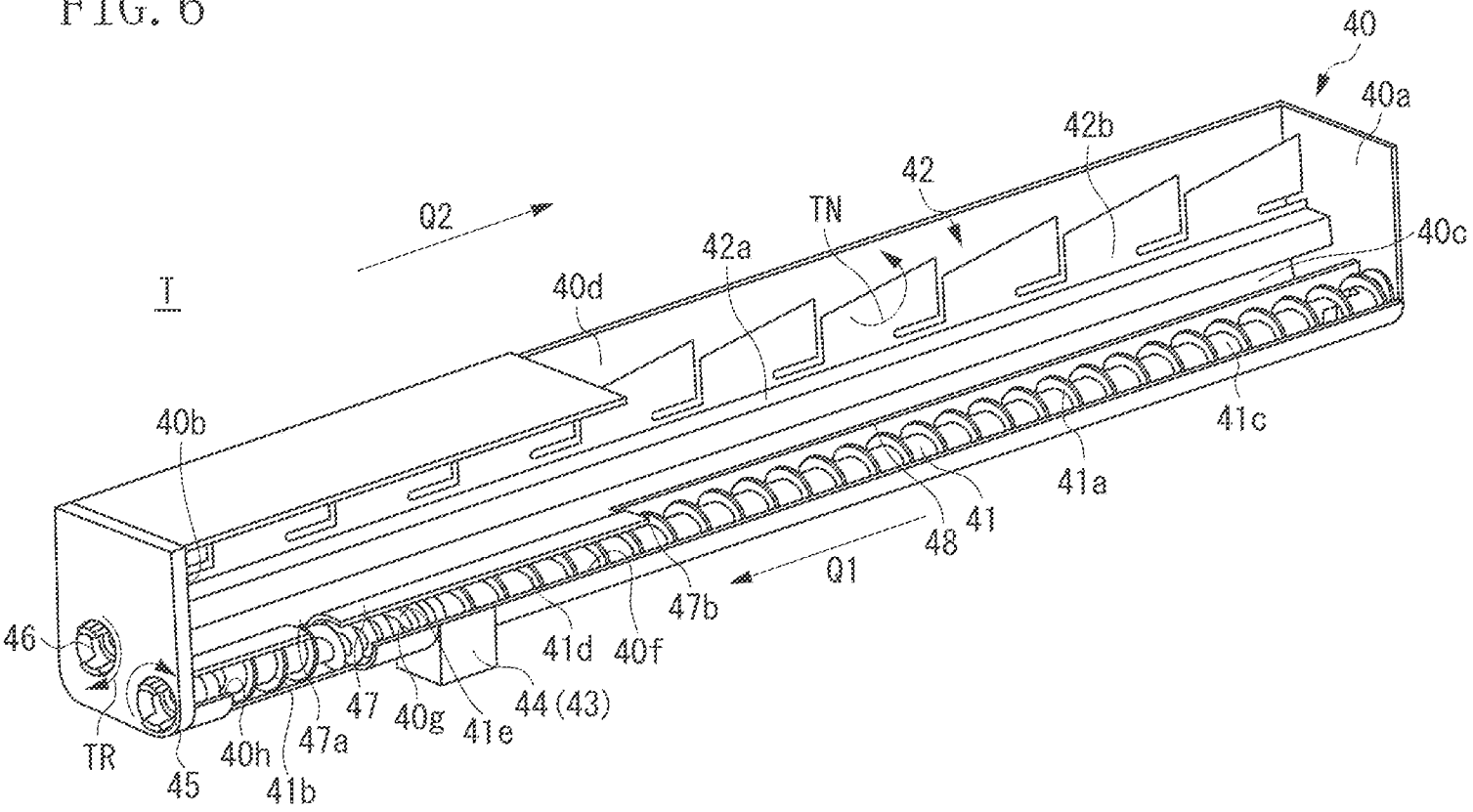
FIG. 6 is a perspective view illustrating a configuration of the developer replenishment cartridge.
Figure 12:
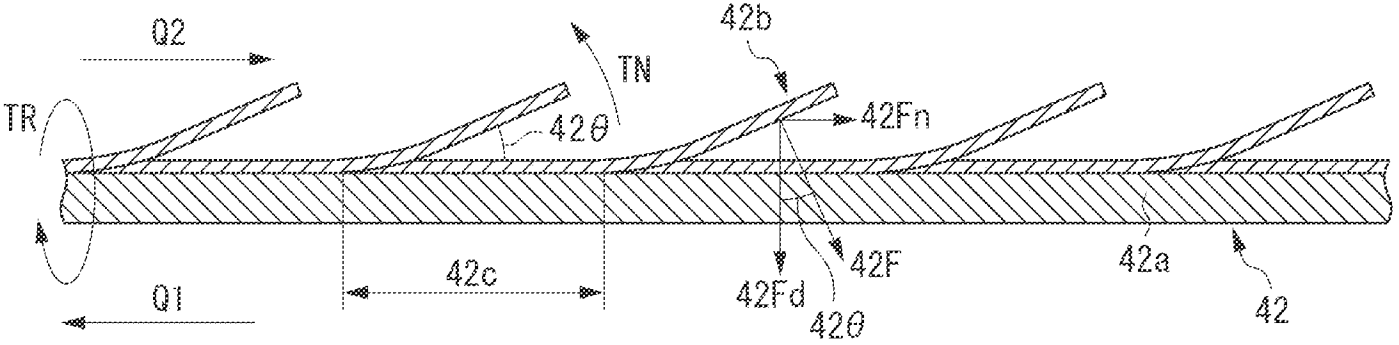
FIG. 12 is a schematic sectional view illustrating a state where a replenishment stirring member conveys a developer in a longitudinal direction.

Next, referring to FIGS. 1, 3, 6, and 12, the configuration of the developer replenishment cartridge T will be described. FIG. 1 is a schematic sectional view illustrating the configuration of the developer replenishment cartridge T according to the present exemplary embodiment. FIG. 3 is a main sectional view illustrating the process cartridge P and the developer replenishment cartridge T. FIG. 6 is a perspective view illustrating the configuration of the developer replenishment cartridge T. FIG. 12 is a schematic sectional view illustrating a state where a replenishment stirring member 42 disposed in the developer replenishment cartridge T conveys the developer in a longitudinal direction.

As illustrated in FIG. 3, the developer replenishment cartridge T includes the frame member (hereinafter, "replenishment frame member") 40. The replenishment frame member 40 includes a developer replenishment opening 43 for supplying the developer to the process cartridge P. A developer replenishment shutter 44 is disposed below the developer replenishment opening 43. The developer replenishment shutter 44, which is normally closed, is opened in a state where the process cartridge P and the developer replenishment cartridge T are fixed to the apparatus body 100A.

As illustrated in FIG. 1, the replenishment frame member 40 constitutes a developer storage chamber including a first storage portion (hereinafter, "replenishment stirring chamber") 40*d* in which the replenishment stirring member 42 is disposed, and a second storage portion (hereinafter, "replenishment conveyance chamber") 40*e* in which a replenishment conveyance member 41 is disposed. The developer storage chamber (replenishment stirring chamber 40*d* and replenishment conveyance chamber 40*e*) stores the developer. The replenishment frame member 40 includes a replenishment frame member first end side 40*a* and a replenishment frame member second end side 40*b*. A direction from the replenishment frame member first end side 40*a* to the replenishment frame member second end side 40*b* is defined as an arrow direction Q1, and a direction from the replenishment frame member second end side 40*b* to the replenishment frame member first end side 40*a* is defined as an arrow direction Q2.

The replenishment conveyance member 41 and the replenishment stirring member 42 are rotatably supported by the replenishment frame member 40. The replenishment conveyance member 41 conveys the developer in the replenishment frame body 40 toward the developer replenishment opening 43. As illustrated in FIG. 6, the replenishment conveyance member 41 is a screw member that includes a spiral fin 41*a* and a return fin 41*b* formed on a surface of a replenishment conveyance shaft portion 41*c*. The fin 41*a* conveys the developer in the arrow direction Q1. The return fin 41*b* conveys the developer in a direction opposite that of the fin 41*a*.

A wall member 48, serving as a partition member, and a cover member 47 are arranged above the replenishment conveyance member 41. The wall member 48 is a first partition portion of the partition member. The replenishment stirring chamber 40*d* and the replenishment conveyance chamber 40*e* communicate with each other on the wall member 48, and toner moves from the replenishment stirring chamber 40*d* over the wall member 48 to the replenishment conveyance chamber 40*e*. In other words, the wall member 48 is formed with a height to permit movement of the toner from the replenishment stirring chamber 40*d* to the replenishment conveyance chamber 40*e*.

The cover member 47 is a second partition portion of the partition member, which covers a part of the replenishment conveyance member 41 in the longitudinal direction and the developer replenishment opening 43. At the part of the replenishment conveyance member 41 covered with the cover member 47, the amount of a conveyed developer can be more easily kept constant. In other words, the cover member 47 provides an effect of keeping constant the amount of a developer discharged from the developer replenishment opening 43 by the replenishment conveyance member 41.

The cover member 47 includes a communication hole (hereinafter, "return hole") 47*a* formed to return the developer of the replenishment conveyance chamber 40*e* to the replenishment stirring chamber 40*d*.

In the replenishment conveyance chamber 40*e*, a region where the replenishment conveyance member 41 is covered with the cover member 47 can be divided into three sections: a first replenishment conveyance chamber 40*f* that covers the replenishment conveyance member 41 within a range from a cover member entrance 47*b* to the developer replenishment opening 43; a second replenishment conveyance chamber 40*g* that covers the replenishment conveyance member 41 within a range from the developer replenishment opening 43 to the return hole 47*a*; and a replenishment return chamber 40*h* that covers the replenishment conveyance member 41 within a range from the return hole 47*a* to the replenishment frame member second end side 40*b*.

The fin 41*a* includes a first conveyance portion (hereinafter, "first replenishment conveyance portion") 41*d* disposed in the first replenishment conveyance chamber 40*f* and located on the upstream side of the developer replenishment opening 43 in the developer conveying direction (arrow direction Q1 illustrated in FIG. 1) of the fin 41*a*. The fin 41*a* further includes a second conveyance portion (hereinafter, "second replenishment conveyance portion") 41*e* disposed in the second replenishment conveyance chamber 40*g* and located on the downstream side of the developer replenishment opening 43 and the upstream side of the return hole 47*a*.

The developer conveying direction Q1 of the fin 41*a* is a direction from the entrance 47*b* of the cover member 47 toward the return hole 47*a* formed in the cover member 47. In other words, the first replenishment conveyance portion 41*d* and the second replenishment conveyance portion 41*e* convey the developer from the entrance 47*b* toward the return hole 47*a*.

The first replenishment conveyance portion 41*d* includes a fin having a first replenishment conveyance pitch 41*f* from the replenishment frame member first end side 40*a* through the entrance 47*b* of the cover member 47 to the developer replenishment opening 43. The second replenishment conveyance portion 41*e* includes a fin having a second replenishment conveyance pitch 41*g*. The second replenishment conveyance pitch 41*g* is shorter than the first replenishment conveyance pitch 41*f*.

The replenishment stirring member 42 has two roles: stirring of the developer in the replenishment frame member 40, and feeding of the stirred developer to the replenishment conveyance member 41. As illustrated in FIG. 1, the replenishment stirring member 42 includes a replenishment stifling shaft portion 42*a* and a flexible replenishment stifling sheet portion 42*b*. The replenishment stirring shaft portion 42*a* is rotatably supported by the replenishment frame member 40 and a replenishment stirring coupling 46. The replenishment stirring sheet portion 42*b* is divided at fixed intervals 42*c*, and each rational radial-direction leading end is inclined in the longitudinal direction so that a free sheet length 42*d* of the replenishment frame first end side 40*a* can be longer than a free sheet length 42*e* of the replenishment frame second end side 40*b*. Accordingly, when the replenishment stirring member 42 rotates in an arrow direction TR illustrated in FIG. 6, the replenishment stirring sheet portion 42*b* receives, while stifling the developer, a reactive force from the developer to be twisted by an angle 42θ in an arrow direction TN illustrated in FIG. 12. When the replenishment stifling member 42 further rotates in the arrow direction TR in this state, the developer in the replenishment stirring chamber 40*d* receives a stifling conveyance force 42F of a direction normal to a surface of the replenishment stifling sheet portion 42*b*. In this case, the following relationship is established, where a component of the arrow direction Q2 of the stifling conveyance force 42F is a stifling conveyance longitudinal force 42Fn and a component of the arrow direction TR is a stifling conveyance short force 42Fd:

$$42Fn=42F\times\sin\theta$$

$$42Fd=42F\times\cos\theta$$

Thus, the replenishment stifling member 42 applies the stirring conveyance force 42F to the developer to convey the developer while stirring the developer in the arrow direction TR, and feeds the developer from the return hole 47*a* toward the replenishment frame member first end side 40*a* of the replenishment conveyance member 41. The developer conveyed by the replenishment stirring member 42 moves, each time the replenishment stifling member 42 rotates, from the replenishment stifling chamber 40*d* over the wall member 48 to the replenishment conveyance chamber 40*e*. In other words, the replenishment stirring member 42 allows the developer to circulate between the replenishment stifling chamber 40*d* and the replenishment conveyance chamber 40*e*.

At longitudinal ends of the replenishment conveyance member 41 and the replenishment stirring member 42 on the replenishment frame member second end side 40, a replenishment conveyance coupling 45 and a replenishment stirring coupling 46 are respectively arranged. The replenishment conveyance coupling 45 and the replenishment stirring coupling 46 are engaged with the coupling (not illustrated) of the apparatus body 100A. By transmitting a driving force of the driving motor (not illustrated) of the apparatus body 100A to the replenishment stirring coupling 46, the replenishment conveyance member 41 and the replenishment stirring member 42 are driven to rotate at a predetermined speed.

Referring to FIG. 1, the conveyance of the developer in the developer replenishment cartridge T will be described. The developer in the replenishment frame member 40 is stirred by the replenishment stifling member 42, and fed over the wall member 48 (refer to FIG. 6) to the replenishment conveyance member 41 of the replenishment conveyance chamber 40*e*. The developer fed to the replenishment conveyance member 41 is partially regulated by the cover member 47 after it has been conveyed to the cover member 47. The developer discharged from the developer replenishment opening 43 passes through the first replenishment conveyance chamber 40*f*. The developer conveyed in the first replenishment conveyance chamber 40 is discharged from the developer replenishment opening 43 in an arrow direction TA to be supplied to the process cartridge P. A residual of the developer is partially conveyed to the second replenishment conveyance chamber 40*g*. The developer conveyed to the second replenishment conveyance chamber 40*g* is fed from the return hole 47*a* in an arrow direction TL to the replenishment stirring chamber 40*d* by the second replenishment conveyance portion 41*e*.

The developer in the replenishment return chamber 40*h* is also fed from the return hole 47*a* in the arrow direction TL to the replenishment stifling chamber 40*d* by the return fin 41*b*. The return fin 41*b*, which is a third conveyance portion of the second replenishment conveyance member 41, conveys the developer in a direction opposite that (developer conveying direction Q1) of conveying the developer by the first replenishment conveyance portion 41*d* and the second replenishment conveyance portion 41*e*. The inclusion of the return fin 41*b* enables suppression of staying of the developer on the downstream side of the replenishment opening 43 in the developer conveying direction Q1. Thus, coagulation of the developer in the replenishment return chamber 40*h* can be suppressed more.

The developer fed from the return hole 47*a* to the replenishment stirring chamber 40*d* is conveyed in the arrow direction Q2 while being stirred again by the replenishment stirring member 42. Thus, the developer in the developer replenishment cartridge T is circulated in the replenishment frame member 40 by the replenishment conveyance member 41 and the replenishment stirring member 42, and supplied through the developer replenishment opening 43 to the process cartridge P.

Figure 9A:
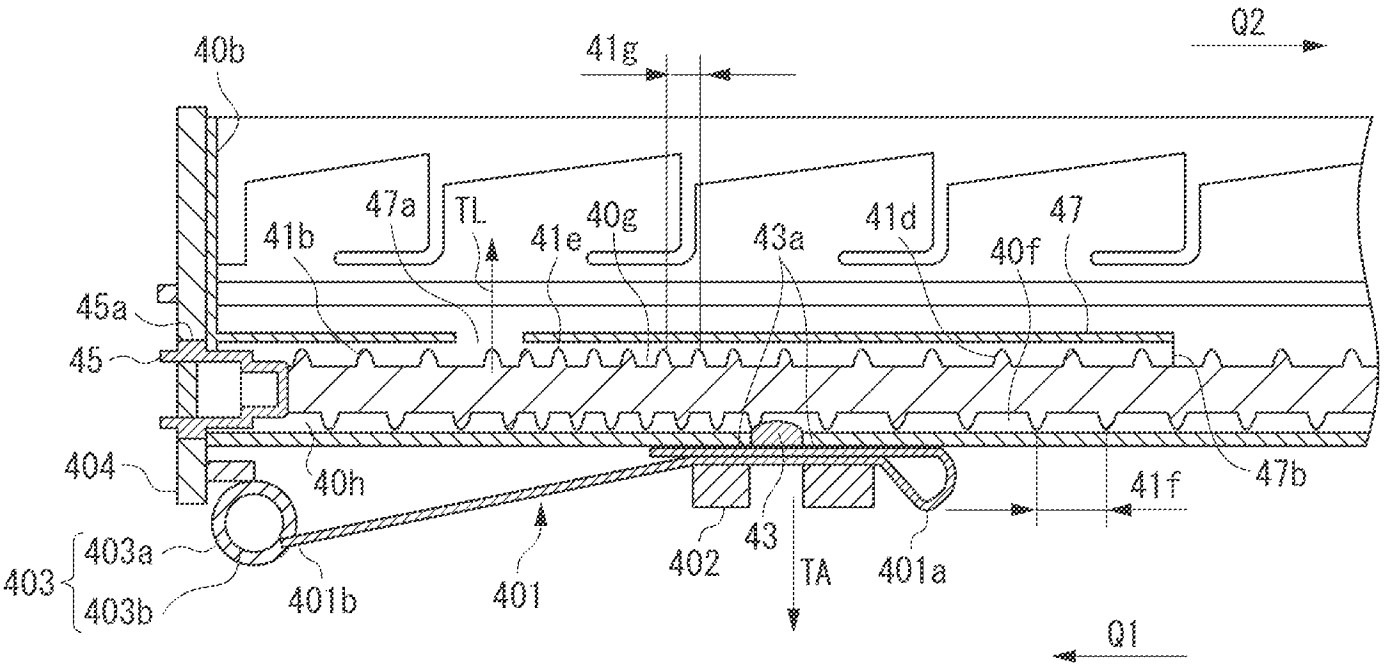
FIGS. 9A, 9B, and 9C are schematic sectional views illustrating the configuration of the developer replenishment cartridge according to the first exemplary embodiment.
Figure 9B:
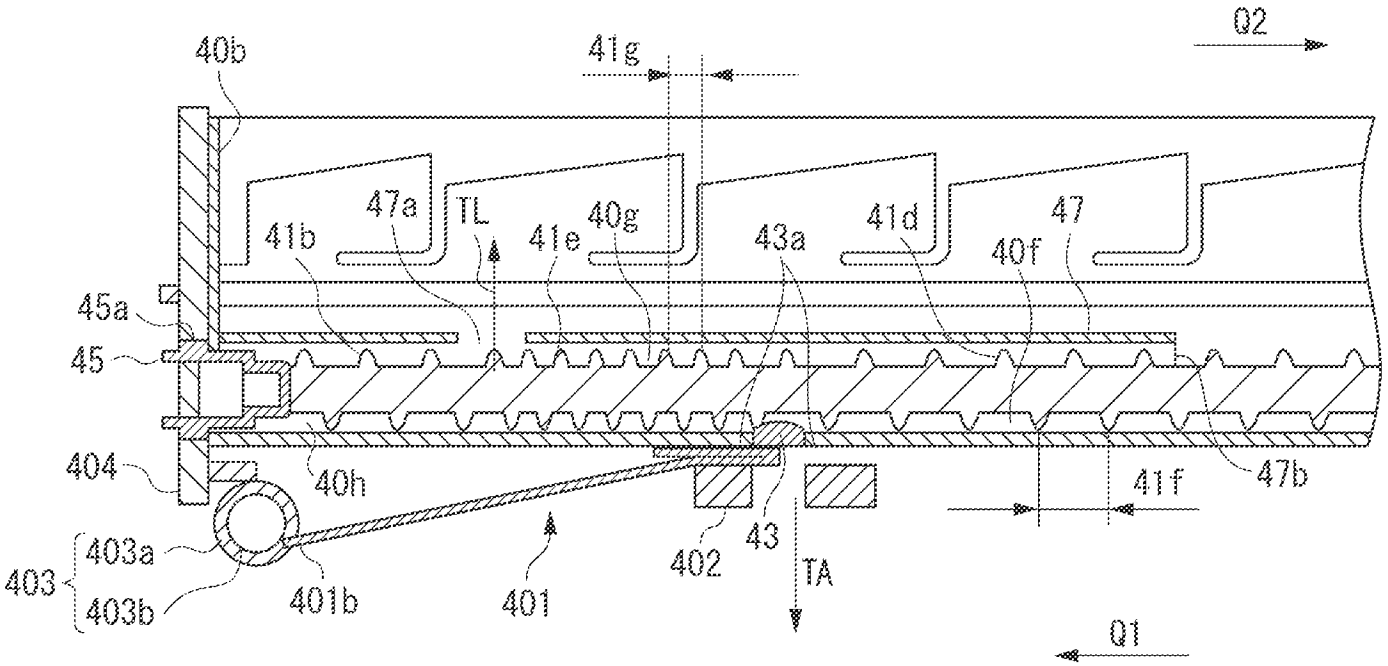
Figure 9C:
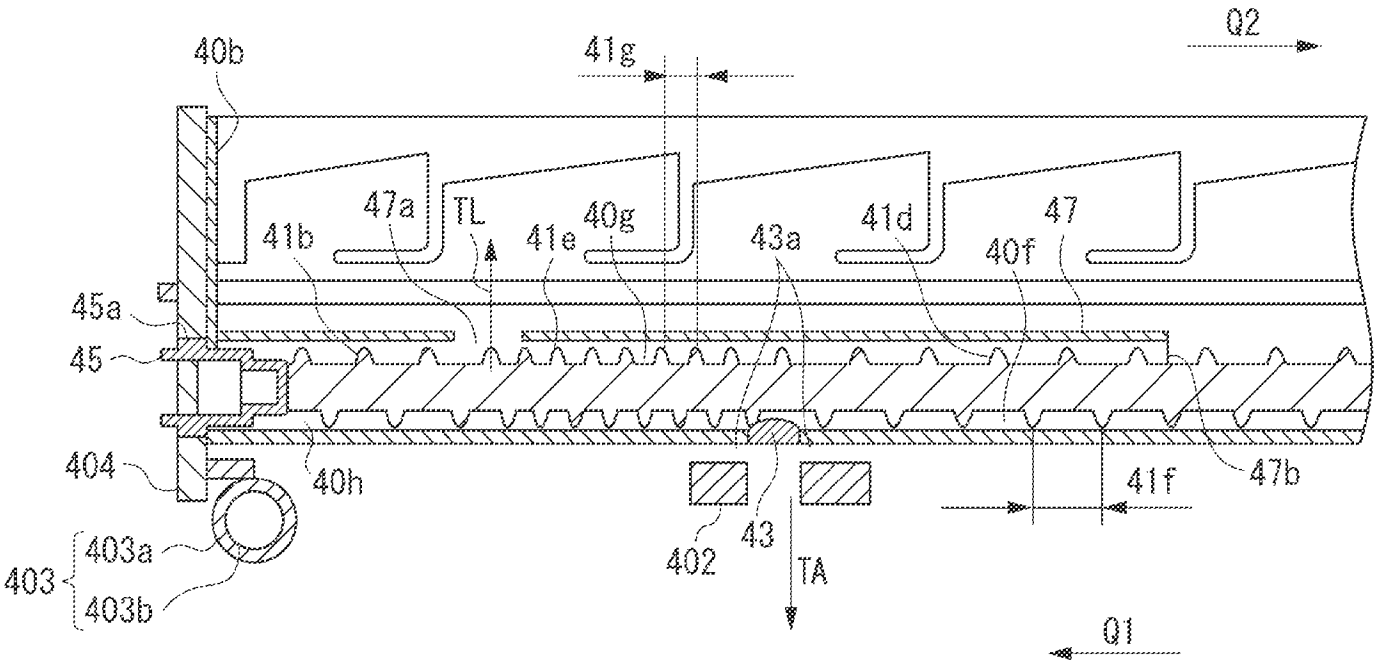

Referring to FIGS. 9A to 9C, a driving configuration of the developer replenishment cartridge T will be described. First, a sealing configuration of the developer replenishment opening 43 during the distribution of the developer replenishment cartridge T and a sealing releasing configuration of the developer replenishment opening 43 when the developer replenishment cartridge T is used for the first time will be described. The developer discharge shutter 44 is not illustrated. As illustrated in FIG. 9A, when the developer replenishment cartridge T is not used, the developer replenishment opening 43 is sealed with a replenishment opening sealing film 401 serving as a sealing member. The replenishment opening sealing film 401 prevents leakage of the developer from the replenishment frame member 40 during the distribution of the developer replenishment cartridge T.

The replenishment opening sealing film 401 is pressed by a replenishment opening sealing member 402 in a state where it is welded to a developer replenishment opening welding portion 43*a* and folded by a replenishment opening sealing film folding portion 401*a*. The replenishment opening sealing member 402 prevents leakage of the developer from the replenishment frame member 40 after the replenishment opening sealing film 401 has been removed. A replenishment opening sealing film longitudinal end 401*b* is coupled with a replenishment take-up member 403 outside the replenishment frame member 40.

The replenishment take-up member 403 includes a replenishment take-up gear portion 403*a* and a replenishment take-up shaft portion 403*b*. The replenishment opening sealing film 401 is bonded to the replenishment take-up shaft portion 403*b* by a double-sided adhesive tape. When the developer replenishment cartridge T is used, driving of the replenishment conveyance coupling 45 is transmitted from a gear portion 45*a* formed in the replenishment conveyance coupling 45 to the replenishment take-up gear portion 403*a* via a replenishment first idler gear 404, and the replenishment take-up member 403 is driven to rotate. Thus, as illustrated in FIG. 9C, the replenishment opening sealing film 401 is taken up to be removed from the developer replenishment opening 43.

Next, an operation of the developer replenishment cartridge T will be described. As described above, the driving of the replenishment conveyance coupling 45 is also transmitted to the replenishment conveyance member 41, and the taking-up operation of the replenishment opening sealing film 401 and the conveyance operation of the developer in the developer conveyance direction Q1 by the fin 41*a* when the developer replenishment cartridge T is used for the first time are simultaneously started.

During the distribution of the developer replenishment cartridge T, the developer replenishment cartridge T receives vibration from a loading platform of a transport vehicle. Thus, a phenomenon where the developer coagulates vertically downward occurs. In addition, during the distribution of the developer replenishment cartridge T, an attitude may be taken where the replenishment frame member second end side 40*b* including the return hole 47*a* is disposed vertically downward. In such a case, the developer coagulates in the second replenishment conveyance chamber 40*g*, the replenishment return chamber 40*h*, and the replenishment frame member second end side 40*b* of the replenishment stirring chamber 40*d* arranged on the downstream side in the developer conveying direction Q1. In the coagulated state of the developer on the downstream side of the developer conveying direction, the replenishment conveyance member 41 cannot smoothly convey the developer in the arrow direction Q1. As a result, driving torque of the replenishment conveyance coupling 45, which is a driving member of the replenishment conveyance member 41, may suddenly increase in initial driving of the developer replenishment cartridge T.

Thus, in the present exemplary embodiment, to prevent extreme enlargement of the driving torque when the developer coagulates, a developer conveyance amount of the second replenishment conveyance portion 41*e* disposed on the downstream side of the replenishment conveyance member 41 in the developer conveying direction Q1 is smaller than that of the first replenishment conveyance portion 41*d*. In other words, the replenishment conveyance member 41 is configured so that the second replenishment conveyance pitch 41*g* can be shorter than the first replenishment conveyance pitch 41*f*. Thus, a developer conveyance amount per unit time in the second replenishment conveyance chamber 40*g* by fixed-speed rotation of the replenishment conveyance member 41 is set lower than that in the first replenishment conveyance chamber 40*f*.

In this case, when the developer coagulates in the second replenishment conveyance chamber 40*g* and the replenishment return chamber 40*h*, the second replenishment conveyance portion 41*e* can suppress further progress of the coagulation of the developer in the second replenishment conveyance chamber 40*g* and the replenishment return chamber 40*h*.

As illustrated in FIG. 9B, at the initial driving time of the developer replenishment cartridge T, the taking-up operation of the replenishment opening sealing film 401 is started to open a part of the developer replenishment opening 43. Accordingly, a greater part of the developer conveyed from the first replenishment conveyance chamber 40*f* by the first replenishment conveyance portion 41*d* is discharged in the arrow direction TA through the partially opened developer replenishment opening 43. As a result, the amount of a developer conveyed to the second replenishment conveyance chamber 40*g* where the developer has coagulated can be suppressed.

When the driving of the developer replenishment cartridge T is further continued, as illustrated in FIG. 9C, the replenishment opening sealing film 401 completely opens the developer replenishment opening 43. The replenishment stirring member 42 conveys the developer in the arrow direction Q2, thereby eliminating the coagulation in the replenishment frame member second end side 40*b* of the replenishment stirring chamber 40*d*. After the coagulation is eliminated in the replenishment stirring chamber 40*d*, the developer is smoothly conveyed from the return hole 47*a* into the replenishment stirring chamber 40*d*, thus eliminating the coagulation of the developer in the second replenishment conveyance chamber 40*g* and the replenishment return chamber 40*h*. As a result, the coagulation of the developer can be eliminated while suppressing a sudden increase of the driving torque of the developer replenishment cartridge T.

To summarize, the pitch of the second replenishment conveyance portion 41*e* located on the downstream side of the developer replenishment opening 43 in the developer conveying direction is set shorter than that of the first replenishment conveyance portion 41*d* located on the upstream side of the developer replenishment opening 43 in the developer conveying direction. In other words, the developer conveyance amount of the second replenishment conveyance portion 41*e* is smaller than that of the first replenishment conveyance portion 41*d*. Thus, when the developer in the replenishment frame member 40 coagulates on the downstream side of the developer conveying direction due to vibration accompanying the distribution, the coagulation progress of the developer can be suppressed even when the replenishment conveyance member 41 is driven. As a result, the sudden increase of the torque at the initial driving time of a developer replenishment cartridge T can be suppressed.

Figure 10:
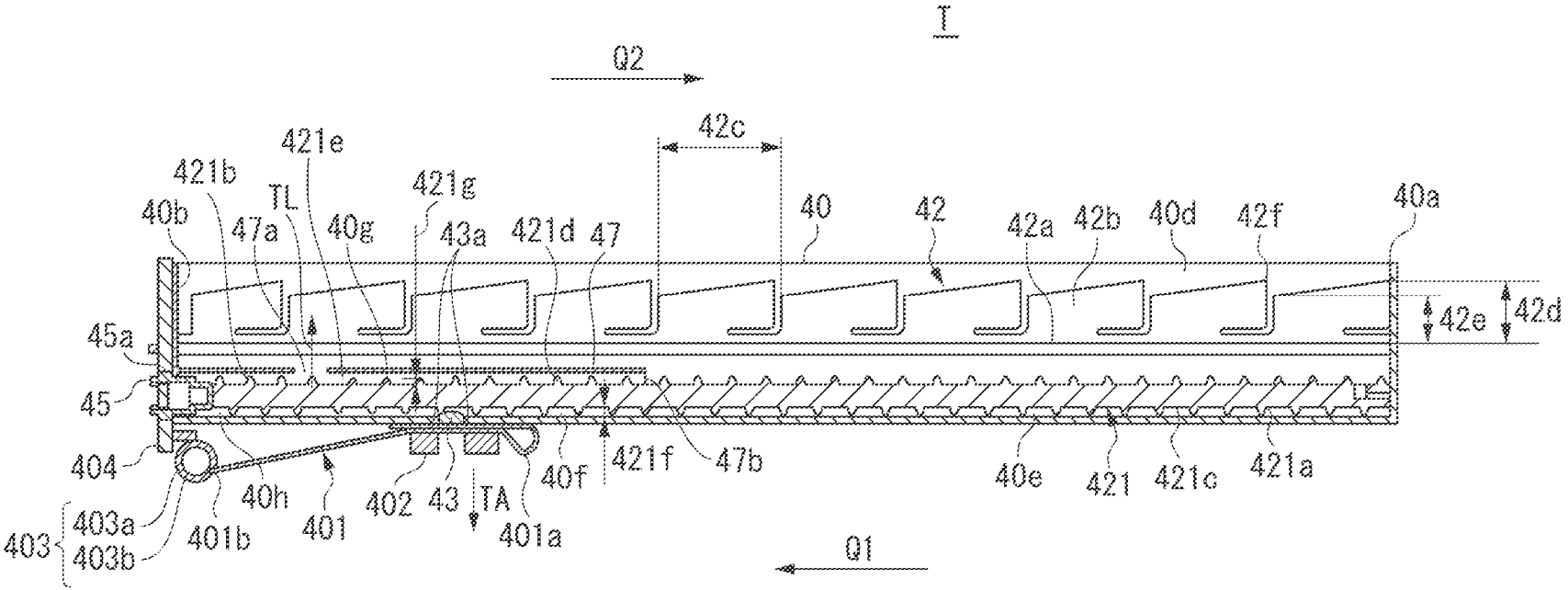
FIG. 10 is a schematic sectional view illustrating a configuration of a developer replenishment cartridge according to a second exemplary embodiment.

Next, referring to FIG. 10, a second exemplary embodiment will be described. Description of portions similar to those of the first exemplary embodiment will be omitted. FIG. 10 is a schematic sectional view illustrating a developer conveyance configuration according to the second exemplary embodiment. A replenishment conveyance member 421 is rotatably supported by the replenishment frame member 40. The replenishment conveyance member 421 conveys a developer in the replenishment frame body 40 toward a developer replenishment opening 43. The replenishment conveyance member 421 is a screw member that includes a spiral fin 421*a* and a return fin 421*b* formed on a surface of a replenishment conveyance shaft portion 421*c*. The fin 421*a* conveys the developer in an arrow direction Q1. The return fin 421*b* conveys the developer in a direction opposite that of the fin 421*a*.

The fin 421*a* according to the present exemplary embodiment includes a first replenishment conveyance portion 421*d* disposed on the upstream side of the developer replenishment opening 43 in the developer conveying direction, and a second replenishment conveyance portion 421*e* disposed in a second replenishment conveyance chamber 40*g*. The first replenishment conveyance portion 421*d* includes a fin having a first replenishment conveyance fin height 421*f* from a replenishment frame member first end side 40*a* through a cover member entrance 47*b* to the developer replenishment opening 43. The second replenishment conveyance portion 421*e* includes a fin having a second replenishment conveyance fin height 421*g*.

The second replenishment conveyance fin height 421*g* is lower than the first replenishment conveyance fin height 421*f*. In other words, a distance from a shaft portion of the replenishment conveyance member 421 to an outer end of a screw as the second replenishment conveyance portion 421*e* is smaller than that from the shaft portion of the replenishment conveyance member 421 to an outer end of a screw as the first replenishment conveyance portion 421*e*.

As a result, a developer conveyance amount per unit time in the second replenishment conveyance chamber 40*g* by fixed-speed rotation of the replenishment conveyance member 41 is set lower than that in the first replenishment conveyance chamber 40*f*.

Thus, as in the case of the first exemplary embodiment, even when the developer in the replenishment frame member 40 coagulates on the downstream side of the developer conveying direction due to vibration accompanying distribution, a sudden increase of torque at the initial driving time of a developer replenishment cartridge T can be suppressed.

Figure 11:
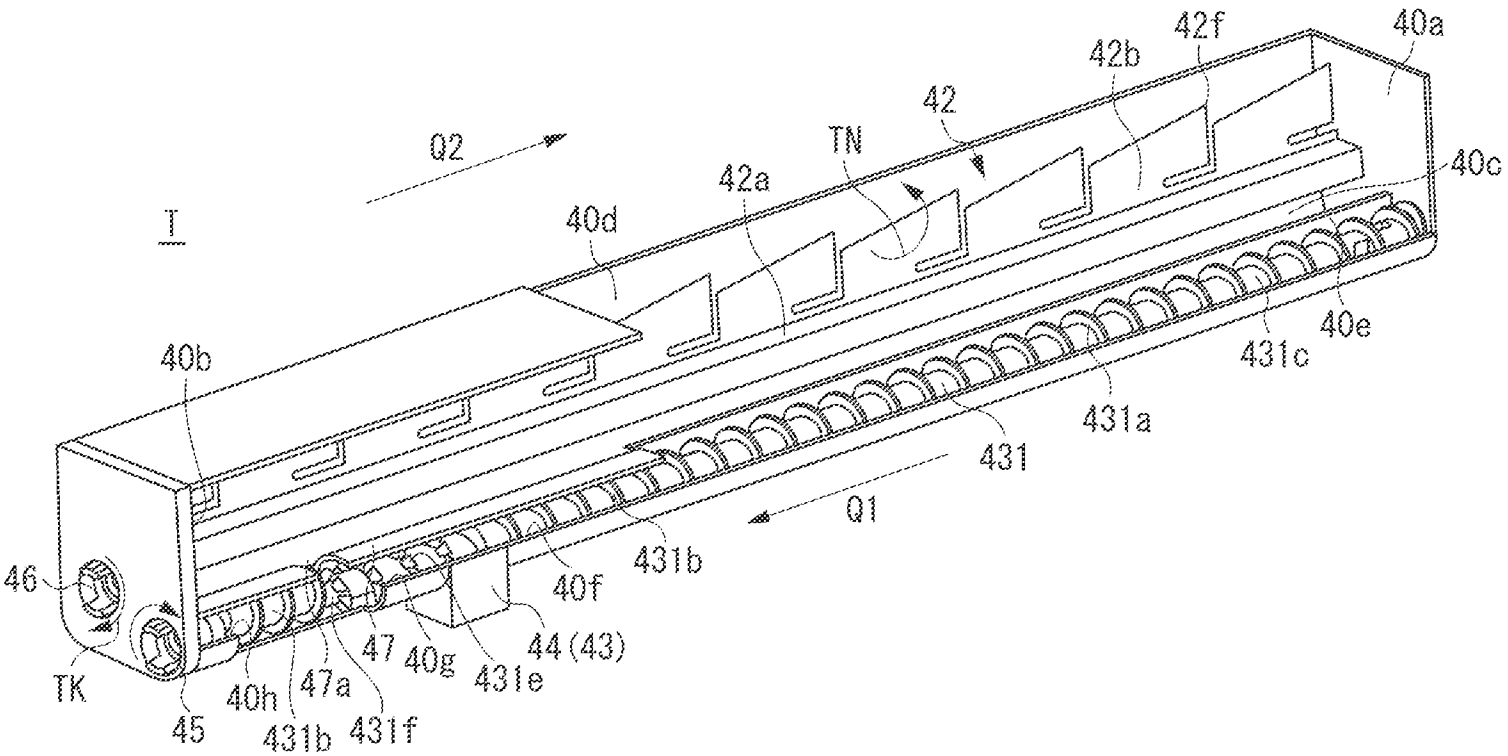
FIG. 11 is a perspective view illustrating a configuration of a developer replenishment cartridge according to a third exemplary embodiment.

Next, referring to FIG. 11, a third exemplary embodiment will be described. Description of portions similar to those of the first exemplary embodiment will be omitted. FIG. 11 is a perspective view illustrating a developer conveyance configuration according to the third exemplary embodiment. A replenishment conveyance member 431 is rotatably supported by a replenishment frame member 40. The replenishment conveyance member 431 conveys a developer in the replenishment frame body 40 toward a developer replenishment opening 43. The replenishment conveyance member 431 is a screw member that includes a spiral fin 431*a* and a return fin 431*b* formed on a surface of a replenishment conveyance shaft portion 431*c*. The fin 431*a* conveys the developer in an arrow direction Q1. The return fin 431*b* conveys the developer in a direction opposite that of the fin 431*a*.

The fin 431*a* according to the present exemplary embodiment includes a first replenishment conveyance portion 431*d* disposed on the upstream side of the developer replenishment opening 43 in the developer conveying direction, and a second replenishment conveyance portion 431*e* disposed in a second replenishment conveyance chamber 40*g*. As illustrated in FIG. 11, the second replenishment conveyance portion 431*e* includes a notch 431*f* with respect to the first replenishment conveyance portion 431*d*. Accordingly, a developer conveyance force of the second replenishment conveyance portion 431*e* in an arrow direction Q1 is lower (suppressed) than that of the first replenishment conveyance portion 431*d*. As a result, a developer conveyance amount per unit time in the second replenishment conveyance chamber 40*g* by fixed-speed rotation of the replenishment conveyance member 41 is set lower than that in the first replenishment conveyance chamber 40*f*.

Thus, as in the case of the aforementioned exemplary embodiments, even when the developer in the replenishment frame member 40 coagulates on the downstream side of the developer conveying direction due to vibration accompanying distribution, a sudden increase of torque at the initial driving time of a developer replenishment cartridge T can be suppressed.

In the exemplary embodiments, the removal unit of the replenishment opening sealing film 401 has been described by using the automatic take-up mechanism installed in the developer replenishment cartridge T. However, the present invention can be applied to a method where the user pulls out the replenishment opening sealing film 401. The exemplary embodiments have been directed to the configuration where the developer replenishment cartridge T and the process cartridge P are independently fixed to the apparatus body 100A. However, the present invention can be applied to a configuration where the developer replenishment cartridge T is formed as an integral part of the process cartridge P. In other words, the present invention can be applied to the process cartridge. Further, the exemplary embodiments have been directed to the laser beam printer even in the case of the apparatus body 100A. However, the present invention can be applied to an image forming apparatus such as a copying machine or a facsimile device.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-270480 filed Dec. 9, 2011, which is hereby incorporated by reference herein in its entirety.

What is claimed is:

1. A cartridge detachably attachable to a main body of an image forming apparatus, the cartridge comprising:

a developer storage chamber partitioned into a first storage portion and a second storage portion and configured to store a developer;

a replenishment opening disposed in the second storage portion, through which the developer passes from inside the developer storage chamber to outside the developer storage chamber;

a conveyance member disposed in the second storage portion and configured to convey the developer in a predetermined conveying direction, the conveyance member including a first conveyance portion located on an upstream side of the replenishment opening to convey the developer in the conveying direction, and a second conveyance portion located on a downstream side of the replenishment opening to convey an amount of a developer smaller than that of the developer conveyed by the first conveyance portion in the conveying direction;

a sealing member configured to seal the replenishment opening;

a removing member configured to remove the sealing member from the replenishment opening by being driven; and a driving force receiving portion configured to receive a driving force to drive the removing member and the conveyance member from the main body of the image forming apparatus.

2. The cartridge according to claim 1, further comprising a partition member configured to partition the developer storage chamber into the first storage portion and the second storage portion, wherein the partition member includes a first partition portion with a height that allows movement of the developer from the first storage portion to the second storage portion, and a second partition portion having a communication port through which the developer moves from the second storage portion to the first storage portion and configured to cover the conveyance member.

3. The cartridge according to claim 1, further comprising a stirring member disposed in the first storage portion and configured to stir the developer.

4. The cartridge according to claim 3, wherein the stifling member is configured to circulate the developer between the first storage portion and the second storage portion by conveying the developer in a direction opposite the conveying direction.

5. The cartridge according to claim 1, wherein the conveyance member further includes a third conveyance portion located on a downstream side of the second conveyance portion in the conveying direction and configured to convey the developer in a direction opposite the conveying direction.

6. The cartridge according to claim 1, wherein the first conveyance portion and the second conveyance portion are screws formed in the conveyance member.

7. The cartridge according to claim 6, wherein a pitch of the screw as the second conveyance portion is shorter than that of the screw as the first conveyance portion.

8. The cartridge according to claim 6, wherein a distance from a shaft portion of the conveyance member to an outer end of the screw as the second conveyance portion is shorter than that from the shaft portion to an outer end of the screw as the first conveyance portion.

9. The cartridge according to claim 1, further comprising a photosensitive drum on which an electrostatic latent image is formed.

10. An image forming apparatus for forming an image on a recording medium, the image forming apparatus comprising:

the cartridge according to claim 1; and a transfer member configured to transfer a developer image formed on a photosensitive drum to the recording medium.

11. A cartridge detachably attachable to a main body of an image forming apparatus, the cartridge comprising:

a developer storage chamber partitioned into a first storage portion and a second storage portion and configured to store a developer;

a replenishment opening disposed in the second storage portion, through which the developer passes from inside the developer storage chamber to outside the developer storage chamber;

a conveyance member disposed in the second storage portion and configured to convey the developer in a predetermined conveying direction, the conveyance member including a first conveyance portion located on an upstream side of the replenishment opening to convey the developer in the conveying direction, and a second conveyance portion located on a downstream side of the replenishment opening to convey an amount of a developer smaller than that of the developer conveyed by the first conveyance portion in the conveying direction;

a sealing member configured to seal the replenishment opening;

a removing member configured to remove the sealing member from the replenishment opening by being driven; and a driving force receiving portion configured to receive a driving force to drive the removing member and the conveyance member from the main body of the image forming apparatus, wherein the second conveyance portion includes a notch formed to suppress a conveyance amount of the developer, and wherein the first conveyance portion and the second conveyance portion are screws formed in the conveyance member.

12. A cartridge detachably attachable to a main body of an image forming apparatus, the cartridge comprising:

a developer storage chamber partitioned into a first storage portion and a second storage portion and configured to store a developer;

a replenishment opening disposed in the second storage portion, through which the developer passes from inside the developer storage chamber to outside the developer storage chamber;

a conveyance member disposed in the second storage portion and configured to convey the developer in a predetermined conveying direction, the conveyance member including a first conveyance portion located on an upstream side of the replenishment opening to convey the developer in the conveying direction, and a second conveyance portion located on a downstream side of the replenishment opening to convey an amount of a developer smaller than that of the developer conveyed by the first conveyance portion in the conveying direction; and a stifling member disposed in the first storage portion and configured to stir the developer;

wherein the stifling member is configured to circulate the developer between the first storage portion and the second storage portion by conveying the developer in a direction opposite the conveying direction.

13. The cartridge according to claim 12, further comprising a sealing member configured to seal the replenishment opening.

* * * * *